US007370464B2

(12) United States Patent
Barea

(10) Patent No.: US 7,370,464 B2
(45) Date of Patent: May 13, 2008

(54) METHOD AND MACHINE FOR FEEDING A YARN TO A TEXTILE MACHINE WITH AUTOMATIC REPLACEMENT OF THE YARN IF INTERRUPTED OR WHEN ITS BOBBIN BECOMES EMPTY

(76) Inventor: Tiziano Barea, Via Valle Olona, 17, 21052 Busto Arsizio (IT)

( * ) Notice: Subject to any disclaimer, the term of this patent is extended or adjusted under 35 U.S.C. 154(b) by 124 days.

(21) Appl. No.: 11/283,770

(22) Filed: Nov. 22, 2005

(65) Prior Publication Data

US 2006/0131459 A1 Jun. 22, 2006

(30) Foreign Application Priority Data

Nov. 26, 2004 (IT) ..... MI2004A2293

(51) Int. Cl.
*D01H 15/00* (2006.01)

(52) U.S. Cl. ..... 57/261; 57/279

(58) Field of Classification Search ..... 57/22, 57/261, 279, 280

See application file for complete search history.

(56) References Cited

U.S. PATENT DOCUMENTS 3,732,677 A * 5/1973 Seem et al. ..... 57/293
2005/0224619 A1* 10/2005 Barea ..... 242/365.7

FOREIGN PATENT DOCUMENTS

EP 1411014 A1 * 4/2004

* cited by examiner

*Primary Examiner*—Shaun R. Hurley
(74) *Attorney, Agent, or Firm*—Young & Thompson

(57) ABSTRACT

A method for feeding a yarn to a textile machine for its processing and preparation for subsequent use, such as an interlacing, texturizing-interlacing or doubling machine, the yarn including at least two threads (3, 4) which are bound together, the first thread (4) and second thread (3) unwinding from a corresponding bobbin, the first (4) of said threads (3, 4) being an elastomeric thread. This latter is unwound from the relative bobbin (6) by withdrawal under free tension, said elastomeric thread (4) then being subjected to tension regulation in order to feed it at constant tension to the next stage, in which it is bound to the other thread.

20 Claims, 3 Drawing Sheets

Figure 1:
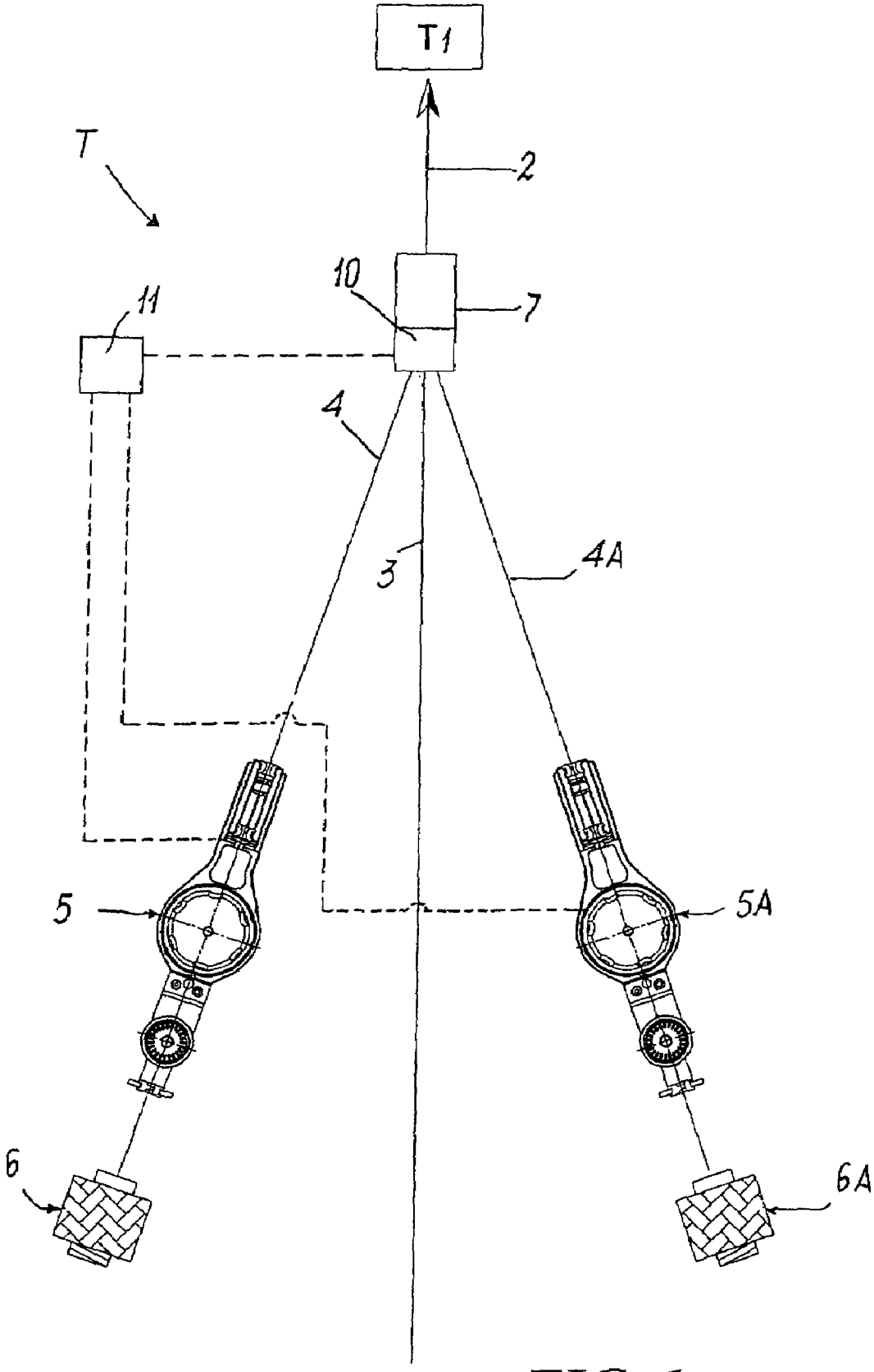

METHOD AND MACHINE FOR FEEDING A YARN TO A TEXTILE MACHINE WITH AUTOMATIC REPLACEMENT OF THE YARN IF INTERRUPTED OR WHEN ITS BOBBIN BECOMES EMPTY

BACKGROUND OF THE INVENTION

1. Field of the Invention

The present invention relates to a method for feeding a yarn to a textile machine for its processing and its arrangement for subsequent use. The invention also relates to a textile machine of the aforestated type in which said method is implemented.

2. Description of the Related Art

A textile machine of the aforesaid type, such as a texturizing-interlacing, interlacing or doubling machine, is known to operate on a yarn comprising at least two threads which are secured together (for example interlaced) in order to be collected on a support (a bobbin or spool) for subsequent use in producing an article in a corresponding different textile machine.

Such known textile machines for transforming textile fibres or yarns combine several identical or different textile fibres or yarns in order to transform the group of fibres or yarns into a yarn or fibre having characteristics which are a combination of the characteristics of each fibre or yarn combined in this manner.

In such machines the production process is normally very lengthy, varying from 30 minutes to more than 60 minutes, depending on the counts processed and on the dimensions of the yarn spool or bobbin produced. The process is also normally highly automated, using autodoffing of the spool produced.

In many of these machines, and in particular in machines for interlacing or texturizing and interlacing a synthetic fibre or thread such as nylon or polyurethane with an elastomeric fibre or thread, this latter is fed to the machine processing region by the so-called Deruile' method, i.e. by unwinding and feeding the yarn from its rotating support bobbin at a speed synchronized with the rate at which the processed yarn is collected on said spool or bobbin. In other words, the bobbin supporting the elastomeric thread rotates about its axis at a speed synchronized with the rotational speed of the bobbin or spool on which the yarn is collected after its processing, said synchronized speed enabling the elastomeric thread to be fed to the machine production region at a constant tension determined on the basis of requirements.

Consequently the ratio of collection speed to elastomer feed speed determines the tension or extension of this latter.

This yarn feeding method presents many limitations related to the modality of continuing yarn feed when the elastomeric thread bobbin runs out. For example, in such machines it is not possible to use the known so-called "head-tail" technique, which when a yarn bobbin has run out enables the production process to continue without interruption because of the presence of a second bobbin, the head of which (i.e. the commencement of the thread supported by it) is linked or rather knotted to the tail of the first (i.e. to the end of the thread supported thereby); the reason for this impossibility is that the threads of these bobbins cannot be knotted together because one of them rotates.

Changing the thread bobbin automatically is extremely complex, costly and limited because when a first bobbin of elastomeric thread runs out it is evidently not possible to automatically start the second at full speed.

Moreover if the elastomeric thread breaks in proximity to its end on the relative bobbin, to prevent its further rapid breakage (with consequent further halting of the textile machine) it is preferred to discard the depleting bobbin for a new bobbin; this evidently results in high costs caused by production discards.

In any event, the known method of feeding the textile machine with the elastomeric thread while maintaining its tension constant by controlling the rotation of the corresponding bobbin never allows complete depletion of the bobbin, with consequent creation of rejects (with their associated costs). This is because the initial layers wound on the preparation bobbin causes it to break the thread on the next before its complete depletion.

For this reason, "Derule'" feed devices require the presence of sensors for monitoring yarn breakage and sensors for indicating the bobbin end. In addition, as a textile machine of the stated type comprises numerous parts ("heads"), each for automatically producing a processed yarn, the number of such "heads" assigned to an operator is very high resulting, in the case of yarn breakage, in prolonged intervention downtimes which can heavily affect final production efficiency levels.

SUMMARY OF THE INVENTION

An object of the present invention is to provide, for processing a yarn, a method and textile machine which are improved compared with the methods and machines of the state of the art.

A particular object of the invention is to provide a method for feeding at least one elastomeric thread to a textile machine of the stated type which overcomes the problems of analogous known methods.

Another object of the present invention is to provide a method which, by means of a new mode for feeding the elastomeric thread, enables the bobbin of this thread to be automatically replaced without halting the textile machine production cycle.

A particular object of the invention is to provide a method of the stated type which enables the automatic yarn change technique known as "head-tail" to be also used in a textile machine of the stated type.

Alternatively, another object of the invention is to provide a method enabling two feed bobbins to automatically be changed over if the elastomeric thread of one of them breaks, or if one of these bobbins runs out, or if the "head-tail" technique is unsuccessful due for example to a badly made knot connecting the "tail" of the depleting thread to the "head" of the new elastomeric thread.

Another object is to provide a method which does not slow down the production process underway, while maintaining efficiency, quality and production at the highest possible levels, substantially equal to 100%.

Another object is to develop a yarn processing method and textile machine of very simple and economical implementation and construction.

A further object is to provide a method which automatically identifies a "tension error", i.e. a situation in which the thread is broken or lacking, or the processed yarn is outside predefined quality limits due for example to mistaken location of the yarn bobbin.

Another object is to provide a method allowing the use of elastomeric thread bobbins of not necessarily standard dimensions, including considerable dimensions, so reducing the number of thread jointing points, and which can be used either by adding it to new generation machines or by updating machines already in client use.

Finally, another object is to provide a method the implementation of which does not require the use of complex synchronizations and mechanical and electronic interfaces within the textile machine, but which instead can be implemented without necessarily having to exchange data or synchronizations with the textile machine.

These and further objects which will be apparent to the expert of the art are attained by a yarn processing method and machine in accordance with the accompanying claims.

BRIEF DESCRIPTION OF THE DRAWING FIGURES

Figure 2:
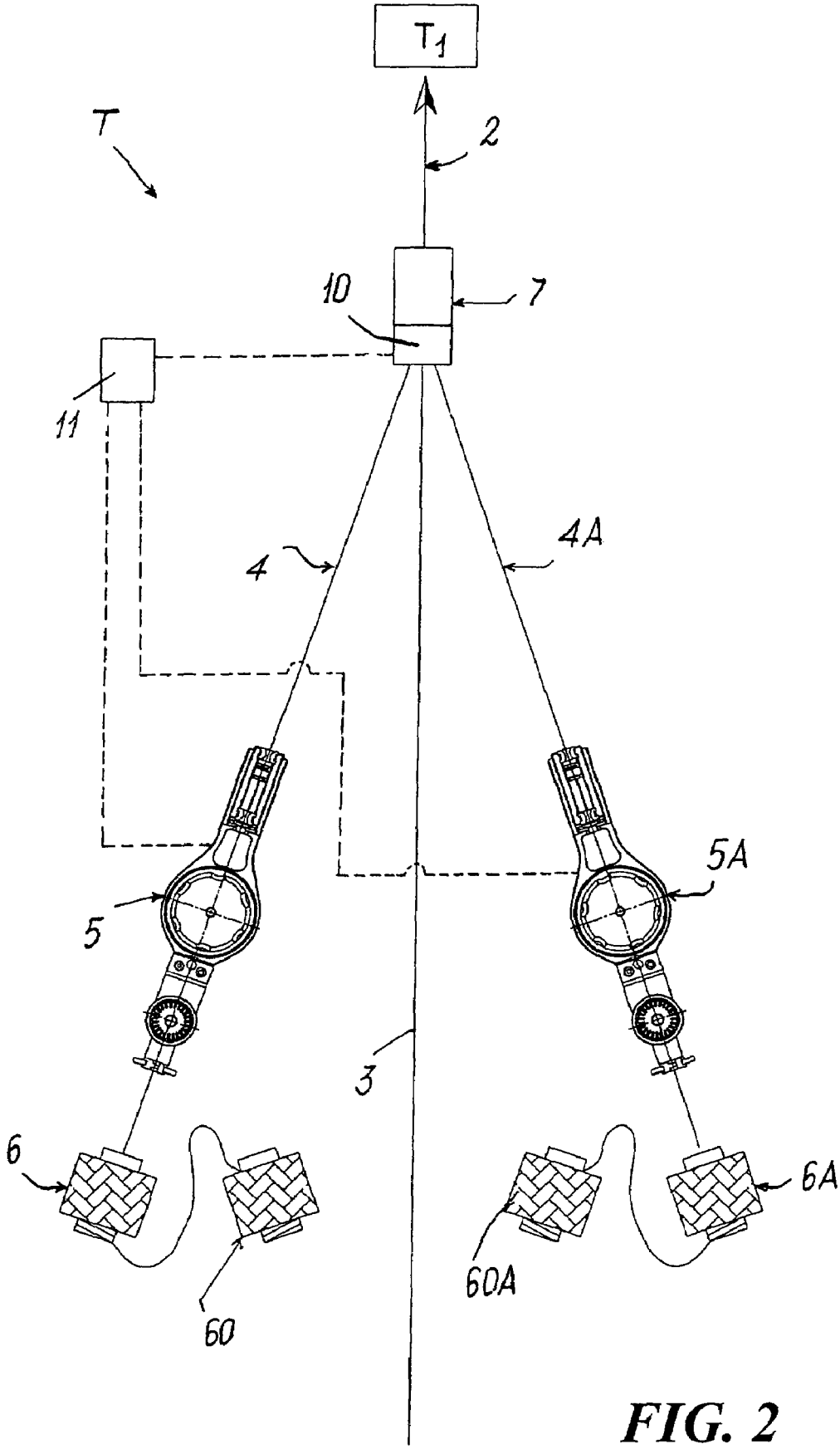
Figure 3:
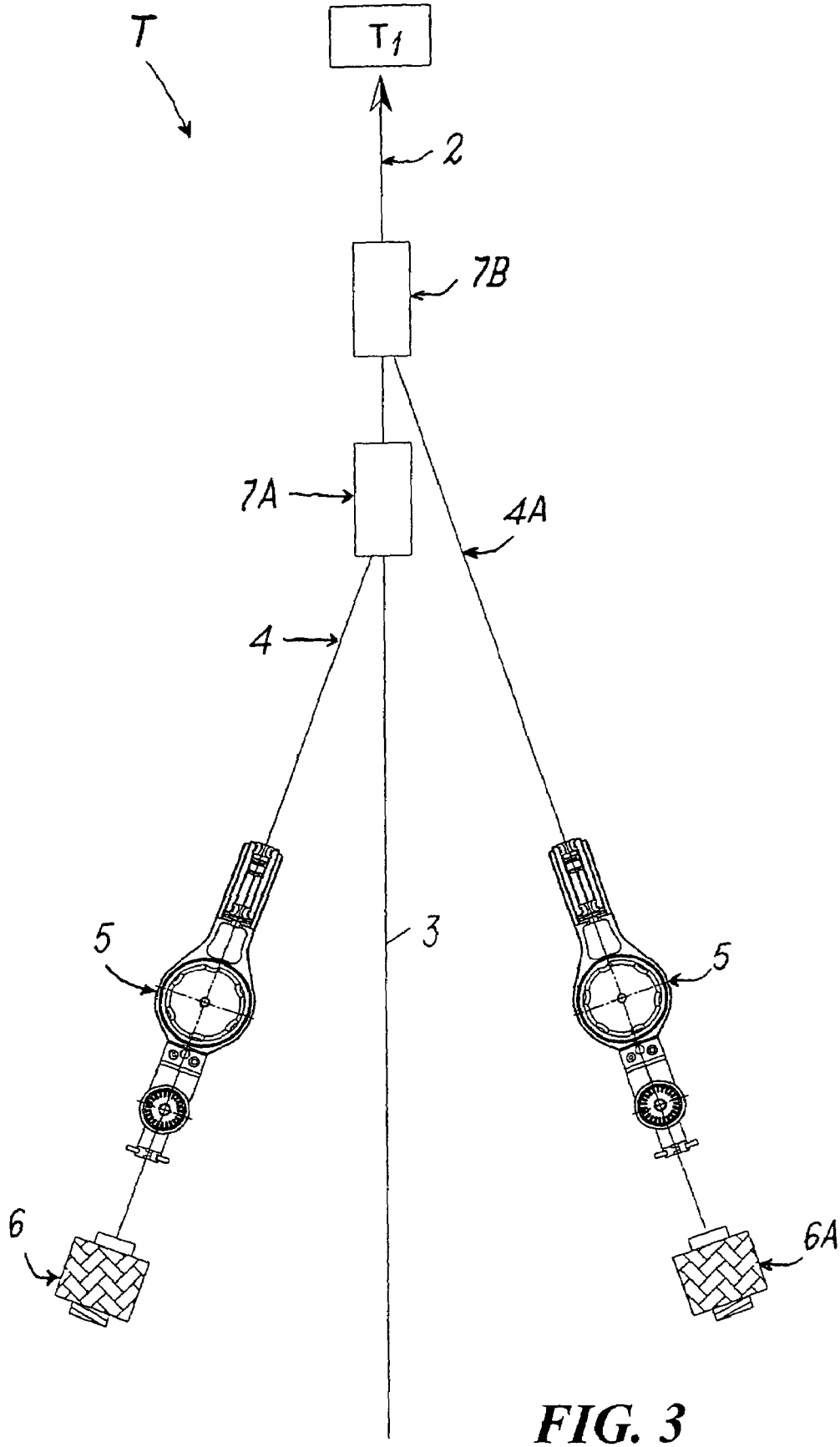

The present invention will be more apparent from the accompanying drawings, which are provided by way of non-limiting example and in which:

FIG. 1 is a block diagram showing a first embodiment of the method of the invention used for automatically replacing a bobbin of elastomeric thread, either because it is empty or because of thread breakage;

FIG. 2 is a block diagram showing a second embodiment of the method of the invention used for complete automatic replacement of the empty elastomeric thread bobbin using the "head-tail" bobbin change technique; and FIG. 3 is a block diagram showing a third embodiment of the method of the invention using an air-operated double interlacer for automatically changing elastomeric thread feed from one bobbin to another.

In the figures, corresponding parts are indicated by the same reference numerals.

DETAILED DESCRIPTION OF THE PREFERRED EMBODIMENTS

With reference to FIG. 1, this shows a textile machine T of the type for processing a yarn and for arranging it on spools or bobbins for its future use in a different textile machine for forming a finished article (for example an item of underwear). The machine T can be an interlacing machine, a texturizing-interlacing machine, or a doubling machine, all known per se.

The machine T presents a yarn processing part T1. This latter operates on a yarn 2 formed by combining, binding or assembling together two threads 3 and 4. For example, the thread 3 is a nylon thread originating from a known feed and drafting device or from a usual yarn bobbin (neither shown here).

The second thread 4 is of elastomeric material; this thread originates from a known constant tension yarn feed device 5 which feeds said thread 4 at a predetermined tension, preferably and advantageously programmable on the basis of the count of the elastomeric thread used and/or of the desired process, said thread originating from a bobbin 6. As stated, the device 5 is known per se: for example such a device can be that described in EP950742 or in U.S. Pat. No. 5,566,574, and is such as to enable the thread 4 to be fed at least at constant tension (and preferably at constant tension and constant rate) equal to a predefined (and advantageously programmable) value. This device is necessary for correct operation of the machine T as the thread 4 unwinds from the bobbin 6 by simple free withdrawal or unwinding, and hence without possessing any predefined tension.

This characteristic of the invention is in contrast to the normal mode of feeding elastomeric thread in a textile machine for yarn processing such as that described, even though machines of this type (for example an interlacing machine) have been available commercially for many decades and even though devices for regulating the tension of a thread fed to a textile machine have also been known for decades in their simplest form. Consequently the present invention is directed towards a chosen technique contrasting that used up to the present time in constructing yarn processing machines of the described type. As described hereinafter, the present invention enables advantages and applications to be obtained which are unattainable by similar textile machines of the state of the art operating by known methods.

The thread 4 originating from the device 5 is combined with the thread 3 to obtain a yarn 2 by inserting these threads into a known combining device (for example an interlacing member) indicated by 7.

According to another characteristic of the invention, as the thread 4 unwinds freely from the bobbin 6 by simple withdrawal therefrom (i.e. by the Defile' method), the thread 4 can be automatically replaced, if the bobbin 6 is about to empty, by another thread 4A originating from another bobbin 6A totally identical with the said bobbin 6. This thread 4A unwinds freely from the bobbin 6A after which it cooperates with a device 5A for adjusting its tension, this being entirely equivalent to or identical with the said device 5.

The thread 4 is replaced by the thread 4A where the threads 4 and 4A enter the combining device 7, by a known change-over device 10 such as a usual thread change-over device similar to that used in knitting, hosiery or weaving machines, or a known air operated interlacing machine or the like. The change-over device 10 can be mechanical, pneumatic, electromagnetic, etc. Its operation is controlled by a control unit 11 to which at least the said devices 5 and 5A are connected; this unit can be part of the device 10.

It will now be assumed that the thread 4 fed by the device 5 from the bobbin 6 is interrupted at the entry or exit of the device 5 by a defect in the thread or because the thread has run out on the bobbin.

In that case the device 5 generates an error signal to immediately note this situation (for example, if the device 5 is of the type described in U.S. Pat. No. 5,566,574, it generates a "Tension Error" signal), this signal being fed to the unit 11. The device 5 consequently generates an alarm signal which is used by the unit 11 to activate the thread change-over device 10 which operates immediately on the thread 4A instead of on the preceding thread 4. In this manner the part 1A of the machine 1 can continue the yarn processing without any interruption.

In the meantime, the operator in charge of the machine has all the time necessary to note the abnormality and to change the now empty bobbin 6 or repair the thread 4 which was interrupted. In either case the thread 4 is again connected (in known manner) to the device 5 and the thread 4 again associated with the change-over device 10 to enable this latter to again effect a change-over when the thread 4A runs out or breaks.

Each time a change-over is signalled, a request can be fed to the operator to intervene and a signal be fed to the textile machine indicating that thread change-over has taken place, in order if necessary to mark the yarn bobbins produced if this production is to be classified as second choice.

If a double indication of thread change-over takes place originating from both the devices 5 and 5A and fed to the unit 11, an alarm signal can be generated to halt the process on the textile machine T, as production is impossible without both the threads 4 and 4A.

This solution evidently enables potentially perpetual production to take place in spite of any breakages or run-outs of the threads 4 or 4A from the bobbins 6 and 6A respectively, hence ensuring a production efficiency close or equal to 100%.

In contrast, FIG. 2 shows a solution operating as described for FIG. 1, but using pairs of thread bobbins 6 and 60 together with 6A and 60A, enabling thread bobbin change-over to take place by the "Head-Tail" method without giving rise to any process defect which may have been caused by the time, even though short, required for thread replacement by the device 10 (in this respect it must be considered that processing may take place at very high speeds), to hence produce only first choice yarn even if the thread has to be changed over. Hence in the case of thread breakage, change-over between the thread 4 and the thread 4A is done by the device 10.

FIG. 3 shows a further solution operated in the same manner as the solution of FIG. 1, but with the difference that the thread change-over device 10 is replaced by two combining devices 7A, 7B (for example, usual known air-operated interlacing devices). Said devices 7A and 7B are activated by the feed device 5A in the case of breakage or run-out of the thread 4A and by the feed device 5 in the case of breakage of the thread 4. When one of said devices 7A and 7B is not in operation, it allows each thread present at its entry to pass without acting on it and simply operates as a thread guide.

Because of the particular manner of unwinding each elastomeric thread from its respective bobbin and the fact that the regulation of its feed tension to the processing part of the textile machine is independent of parameters related to the collection of the processed yarn, the textile machine can be simplified in its construction and in its operation control part. Elastomeric thread bobbins of any size can be used, as there are no restrictions relating to the manner of supporting the bobbin, such restrictions however existing in known machines because of the fact that in these latter the thread tension is controlled by controlling the rotation of the bobbin on its own support shaft.

Moreover, because of the particular manner of unwinding said thread, the invention enables the elastomeric thread used in the process to be replaced by another thread when the former breaks or runs out on its corresponding bobbin. This enables textile machine operation to be maintained for a considerable time independently of the quantity of elastomeric thread present on the respective bobbin.

Numerous embodiments of the invention can be obtained in the light of the aforegoing description by suitably choosing the aforedescribed devices, while still implementing a method and achieving a textile machine in accordance with the ensuing claims.

The invention claimed is:

1. A method for feeding a yarn to a textile machine for its processing and preparation for subsequent utilization, comprising:

providing said yarn comprising at least first and second threads (3, 4) which are bound together;

unwinding said first thread (3) and second thread (4) from a corresponding bobbin, the second thread (4) being an elastomeric thread, the second thread (4) being unwound from a relative bobbin (6) by withdrawal under free tension;

subjecting said elastomeric second thread (4) to tension regulation in order to feed said elastomeric second thread (4) at constant tension to a next stage, in which said elastomeric second thread (4) is bound to the first thread (3), the tension of the elastomeric second thread (4) being regulated on the basis of a predefined value, said value being maintained during the entire processing of the yarn by the textile machine, wherein said first and second threads (3, 4) are fed to a device (7) for binding them together, a third thread (4A) of elastomeric material reaching said device (7), change-over means (10) being provided to allow said binding device to operate on said third thread (4A) whenever the feed of the second thread of elastomeric material (4) presents an error and the first thread (3) is not fed to said binding device (7), said third thread (4A) being unwound by withdrawal under free tension from its own bobbin (6A) and being subjected to tension regulation before reaching said binding device (7).

2. The method as claimed in claim 1, wherein the binding device acts automatically on said third thread (4A).

3. The method as claimed in claim 1, wherein the error in the feed of the second thread of elastomeric material (4) is due to its absence.

4. The method as claimed in claim 3, wherein the absence of the thread is due to a breakage of the second thread of elastomeric material (4).

5. The method as claimed in claim 3, wherein the absence of the thread is due to depletion of the second thread of elastomeric material (4) on the corresponding bobbin (6).

6. The method as claimed in claim 1, wherein the error in the yarn feed is identified during regulation of its tension.

7. The method as claimed in claim 6, wherein by generating an error signal whenever the regulated tension does not correspond to the predefined value.

8. The method as claimed in claim 7, wherein said error signal results in stoppage of the textile machine (T).

9. The method as claimed in claim 1, wherein the feed of each thread of elastomeric material takes place by the head-tail method.

10. The method as claimed in claim 1, wherein by feeding the third thread (4A) to a binding device (7B) different from that (7A) reached by the second thread of elastomeric material (4), said different binding device (7B) being activated when the error in the feed of the second thread of elastomeric material (4) is sensed.

11. The method as claimed in claim 1, wherein by signalling that change-over between said elastomeric threads (4, 4A) has taken place to a yarn processing part (T1) of the textile machine (T).

12. The method as claimed in claim 1, wherein by recording the quantity of yarn processed by the textile machine (T) subsequent to change-over between the elastomeric threads (4, 4A).

13. The method as claimed in claim 1, wherein by halting the textile machine (T) whenever an error in the feed of each thread of elastomeric material (4, 4A) is sensed.

14. A machine for processing a yarn (2) and preparing it for its subsequent use in a different textile machine for producing an article, said processing machine (T) comprising:

a yarn processing part (T1) to which said yarn (2) leaving a device (7, 7A, 7B) for binding at least two threads (3, 4, 4A) together is fed, a second of said threads (4) being of elastomeric material and unwinding from a corresponding bobbin (6, GA), said thread of elastomeric material (4, 4A) unwinding by withdrawal under free tension from the relative bobbin (6, 6A); and tension regulator means (5, 5A) interposed between said bobbin (6, 6A) and said binding device (7, 7A, 7B) to act on said thread of elastomeric material (4, 4A) in order to regulate tension of said elastomeric material (4, 4A) in accordance with a predetermined parameter, said tension regulator means (5, 5A) being a device for automatically regulating the tension at a predetermined value and for maintaining the thread of elastomeric material (4, 4A) at a constant tension, wherein by presenting a third thread (4A), of elastomeric material, to replace or be changed-over with the second thread of elastomeric material (4) whenever this latter presents a feed error at the binding device (7), means (10) being provided for change-over between said elastomeric threads (4, 4A) whenever said error exists, the third thread (4A) being unwound by withdrawal from its own bobbin (6A) and cooperating with tension regulator means (SA) before its entry into said binding device (7).

15. The textile machine as claimed in claim 14, wherein said change-over means (10) are controlled by the tension regulator means (5, 5A) with which the elastomeric threads (4, 4A) cooperate.

16. The textile machine as claimed in claim 15, wherein by comprising, for said changeover means (10), control means (11) connected to said tension regulator means (5, 5A).

17. The textile machine as claimed in claim 14, wherein the bobbin (6, 6A) from which each thread of elastomeric material (4, 4A) unwinds is connected to a further bobbin (60, 60A) by the head-tail method.

18. The textile machine as claimed in claim 14, wherein each elastomeric thread (4, 4*a*) reaches its own binding device (7A, 7B) and cooperates with its own change-over device (10A, 10B).

19. A method for feeding a yarn to a textile machine for its processing and preparation for subsequent utilization, comprising:

providing said yarn comprising at least first and second threads (3, 4) which are bound together;

unwinding said first thread (3) and second thread (4) from a corresponding bobbin, the second thread (4) being an elastomeric thread, the second thread (4) being unwound from a relative bobbin (6) by withdrawal under free tension;

subjecting said elastomeric second thread (4) to tension regulation in order to feed said elastomeric second thread (4) at constant tension to a next stage, in which said second elastomeric thread (4) is bound to the first thread (3), the tension of the elastomeric second thread (4) being regulated on the basis of a predefined value, said value being maintained during the entire processing of the yarn by the textile machine, wherein said first and second threads (3, 4) are fed to a device (7) for binding them together, a third thread (4A) of elastomeric material reaching said device (7), changeover means (10) being provided to allow said binding device to operate on said third thread (4A) whenever the feed of the second thread of elastomeric material (4) presents an error and the first thread is not fed to said binding device (7), said third thread (4A) being unwound by withdrawal under free tension from its own bobbin (6A) and being subjected to tension regulation before reaching said binding device (7), the error in the yarn feed being identified during regulation of its tension, and an error signal is generated whenever the regulated tension does not correspond to the predefined value.

20. A machine for processing a yarn (2) and preparing it for its subsequent utilization in a different textile machine for producing an article, said processing machine (T) comprising:

a yarn processing part (T1) to which said yarn (2) leaving a device (7, 7A, 7B) for binding at least two threads (3, 4, 4A) together is fed, a second of said threads (4) being of elastomeric material and unwinding from a corresponding bobbin (6, 6A), said thread of elastomeric material (4, 4A) unwinding by withdrawal under free tension from the relative bobbin (6, 6A); and tension regulators (5, 5A) interposed between said bobbin (6, 6A) and said binding device (7, 7A, 7B) to act on said thread of elastomeric material (4, 4A) in order to regulate tension of said elastomeric material (4, 4A) in accordance with a predetermined parameter, said tension regulators (5, 5A) being a device for automatically regulating the tension at a predetermined value and for maintaining the thread of elastomeric material (4, 4A) at a constant tension, wherein by presenting a third thread (4A), of elastomeric material, to replace or be changeover with the second thread of elastomeric material (4) whenever this latter presents a feed error at the binding device (7), a device (10) being provided for change-over between said elastomeric threads (4, 4A) whenever said error exists, said change-over device (10) being controlled by the tension regulators (5, 5A) with which the elastomeric threads (4, 4A) cooperate, said change-over device (10) including a controller (11) connected to said tension regulator (5, 5A), the third thread (4A) being unwound by withdrawal from its own bobbin (GA) and cooperating with the tension regulator (5A) before its entry into said binding device (7).

* * * * *